US007778578B2

(12) United States Patent
Takuwa

(10) Patent No.: US 7,778,578 B2
(45) **Date of Patent: *Aug. 17, 2010**

(54) TONER CONTAINER IN IMAGE FORMING APPARATUS

(75) Inventor: Noriyuki Takuwa, Kawasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/892,450

(22) Filed: Aug. 23, 2007

(65) Prior Publication Data

US 2008/0013989 A1 Jan. 17, 2008

Related U.S. Application Data

(63) Continuation of application No. 10/942,110, filed on Sep. 16, 2004, now Pat. No. 7,437,107.

(30) Foreign Application Priority Data

Sep. 19, 2003 (JP) ..... 2003-328485

(51) Int. Cl.
*G03G 15/08* (2006.01)

(52) U.S. Cl. ..... 399/262

(58) Field of Classification Search ..... 399/262
See application file for complete search history.

(56) References Cited

U.S. PATENT DOCUMENTS 5,828,935 A 10/1998 Tatsumi et al.
5,842,092 A * 11/1998 Jyoroku ..... 399/262
6,256,469 B1 7/2001 Taniyama et al.
RE40,058 E 2/2008 Umezawa et al.
2002/0044795 A1* 4/2002 Kato ..... 399/262

FOREIGN PATENT DOCUMENTS

JP 2000-010392 A 1/2000
JP 2001-142288 A 5/2001
JP 2001-188409 A 7/2001

(Continued)

OTHER PUBLICATIONS

N. Takuwa, U.S. PTO Office Action, U.S. Appl. No. 10/942,110, Nov. 16, 2007, 8 pages.

(Continued)

*Primary Examiner*—Stephen D Meier
*Assistant Examiner*—Erika Villaluna
(74) *Attorney, Agent, or Firm*—Foley & Lardner LLP

(57) ABSTRACT

A toner container for use in an image forming apparatus to discharge toner from the toner container upon rotation of the toner container in the image forming apparatus along a direction of a rotation axis of the toner container has a cylindrical body unit for containing a toner; a cylindrical end portion at a first end of the toner container, the cylindrical end portion including a first end face and a second end face; a toner supply port provided in the cylindrical end portion; and a protruded portion provided on the first end face of the first end portion, the first end face being recessed from the second end surface and positioned under said toner supply port.

5 Claims, 8 Drawing Sheets

FOREIGN PATENT DOCUMENTS

| | | | |
|---|---|---|---|
| JP | 2001-228692 | A | 8/2001 |
| JP | 2001-235935 | A | 8/2001 |
| JP | 2001-235937 | A | 8/2001 |
| JP | 2002-221858 | A | 8/2002 |
| JP | 2002-318490 | A | 10/2002 |
| JP | 2002-351203 | A | 12/2002 |
| JP | 2002-365896 | A | 12/2002 |
| JP | 2003-255684 | A | 9/2003 |

OTHER PUBLICATIONS

N. Takuwa, U.S. PTO Notice of Allowance and Fee(s) Due, U.S. Appl. No. 10/942,110, Jun. 13, 2008, 7 pages.
Japanese Office Action with English Translation, dated Apr. 10, 2009, 4 pages.

* cited by examiner

TONER CONTAINER IN IMAGE FORMING APPARATUS

CROSS REFERENCE TO RELATED APPLICATIONS

The present application is a continuation based upon U.S. application Ser. No. 10/942,110, filed Sept. 16, 2004, which claims the benefit of priority from the prior Japanese Patent Application No. 2003-328485, filed on Sept. 19, 2003; the entire contents of all of which are incorporated herein by reference.

BACKGROUND OF THE INVENTION

1. Field of the Invention

The present invention relates generally to a toner container in an image forming apparatus, and more particularly to a toner container utilized for image forming apparatuses such as a copying machine, a printer, a facsimile, etc.

2. Related Background Arts

An image forming apparatus such as a copying machine, a printer, a facsimile, etc. that deal with images, as known well, forms an image by forming an electrostatic latent image on a photosensitive drum, having a toner as a black minute powder adsorbed corresponding to the formed electrostatic latent image and transferring a visible image onto a sheet of paper, etc.

The toner is consumed each time the image is formed and is therefore required to be properly supplied in response to a frequency of forming the image.

For stably supplying the toner, as disclosed in, e.g., Japanese Patent Laid-open (Unexamined) publication No.2001-228692, the image forming apparatus is provided with a toner supply device, whereby the toner contained in the toner container is supplied.

This toner container takes a cylindrical shape having a helical groove formed in its internal surface, and is constructed to move the toner towards a replenishment port provided at an end portion thereof as it is rotated. The toner replenishment port is formed as, for example, a circular hole in the cylindrical surface at the endmost portion of the toner container, and a shutter for opening and closing this replenishment port as it slides in the axial directions of the toner container, is provided for preventing the toner from scattering.

In a toner container of this configuration, the toner should be continuously supplied from the toner replenishment port by simultaneously rotating the toner container.

Moreover, a rotational position of the toner container should be restricted to enable the container to be inserted and taken out within a certain given range so that the toner does not spill from the toner replenishment port directed sideways or downwards.

The Japanese Patent Application Laid-open publication 2001-228692 discloses a toner container that has a protrusion on the surface thereof. In this toner container, in the case where the protrusion directs upward toward the copy machine main body, the toner container can be attached to or detached from the copy machine main body.

However, in such scheme, the posture for enabling detaching is so limited that operability is not good because sometimes the toner container must be rotated nearly 360 degrees.

With an increase in recently-arising demands for forming the images, it is desired that a toner containing quantity per toner container be increased in response to a request for extending a toner exchange period, so that the container is filled with the toner to the proximity to the limit. On the other hand, with a request for downsizing the image forming apparatus, an interior of the image forming apparatus adopts a dense structure that educes an extra space or makes use of the space to the greatest possible degree.

Under such circumstances, if the toner container is inserted and taken out in the event of a paper jam and on the occasion of maintenance other than the toner exchange, the toner might be spilled and also scattered upon receiving a wind of a cooling fan for cooling the interior of the apparatus, depending on a position for inserting and taking the container out, resulting in a problem that a contamination in the interior of the apparatus and a malfunction of a sensor are induced.

Further, the toner container has hitherto been sold in a fashion of being packed one by one in the form of a toner cartridge as an expendable supply. The conventional toner container, however, has projections larger than a major diameter of the container body and therefore needs a larger packing configuration and a larger package than required. This was a factor for raising costs for preservation, transportation and so on.

SUMMARY OF THE INVENTION

Accordingly, it is an object of the present invention to provide a toner container which can discharge toner from the toner replenishment port during its rotation and is superior in operability.

According to one aspect of the present invention, there is provided a toner container for use in an image forming apparatus to discharge toner from the toner container upon rotation of the toner container in the image forming apparatus along a direction of a rotation axis of the toner container comprising:

a cylindrical body unit for containing a toner;

a cylindrical end portion at a first end of the toner container, the cylindrical end portion including a first end face and a second end face;

a toner supply port provided in the cylindrical end portion; and a protruded portion provided on the first end face of the first end portion, the first end face being recessed from the second end face and positioned under said toner supply port.

According to another aspect of the present invention, there is provided a toner container for use in an image forming apparatus to discharge toner from the toner container upon rotation of the toner container in the image forming apparatus, wherein the toner container is adapted for insertion into the image forming apparatus along a direction of a rotation axis of the toner container comprising:

a cylindrical body unit for containing a toner;

a cylindrical end portion at a first end of the toner container, the cylindrical end portion including a first end face and a second end face;

a toner supply port provided in the cylindrical end portion;

a protruded portion provided on the first end face of the first end portion, the first end face being recessed from the second end face and positioned under said toner supply port;

the first end face being recessed from the second end face and positioned under said toner supply port; and a protrusion having a predetermined length provided in a circumferential direction of the cylindrical end portion, the maximum height of the protrusion being smaller than a main diameter of the cylindrical body; a cylindrical surface being provided on the rear side of the protrusion on the cylindrical end portion.

DETAILED DESCRIPTION OF THE INVENTION

An image forming apparatus to which an embodiment of the present invention is applied, will hereinafter be described in detail by exemplifying a copying machine.

Figure 1:
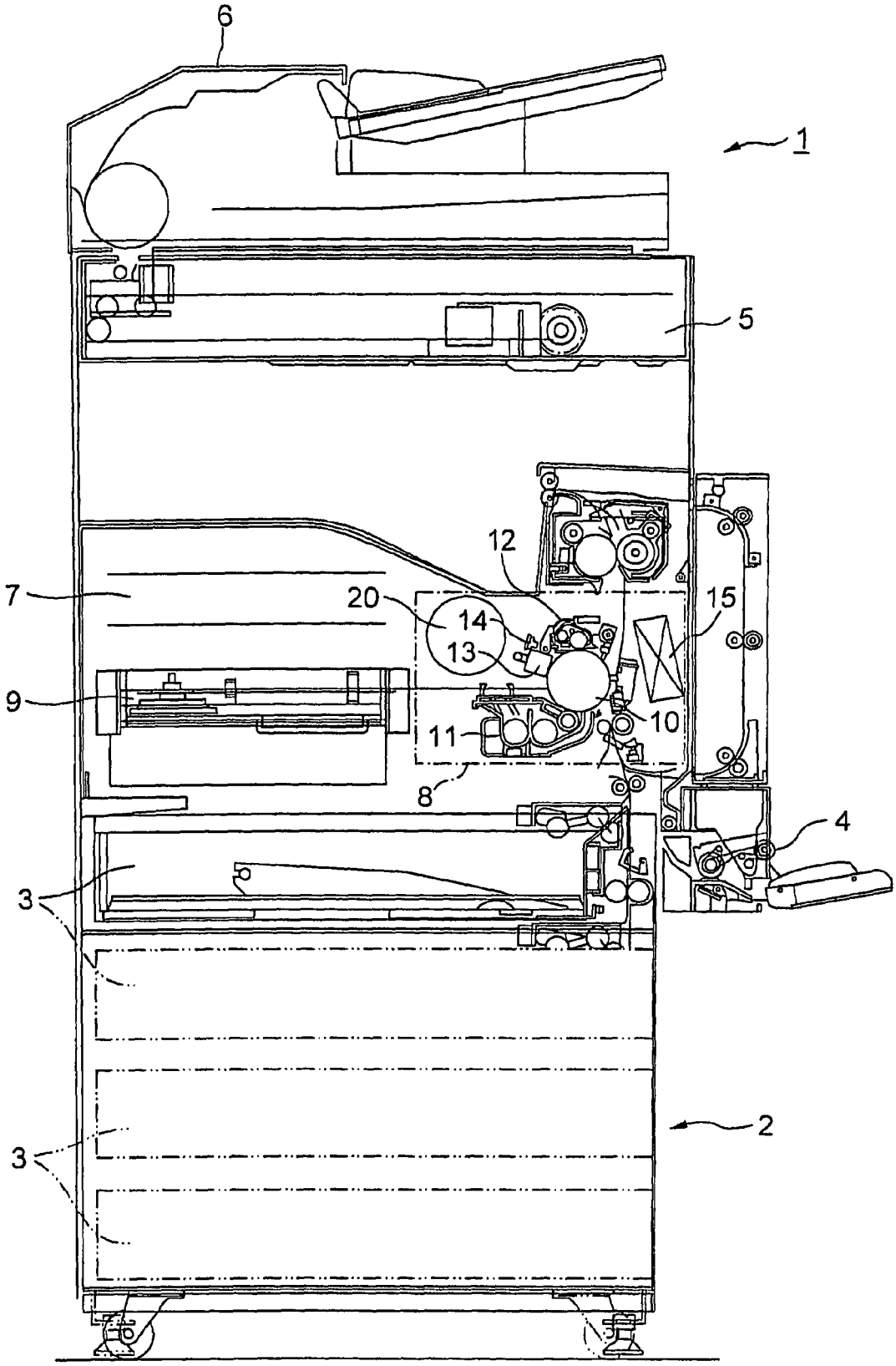
FIG. 1 is a sectional view showing an outline of a construction of a copying machine as an image forming apparatus for which a toner container according to the invention is used.

FIG. 1 is a sectional view showing an overall configuration of a copying machine 1 to which a toner supplying device and a toner container according to the present invention are applied.

The copying machine 1 has, in addition to a paper feed cassette 2 for accommodating a multiplicity of copy sheets in a lower portion of a main body thereof, an LCF paper feed device 3 for feeding a large quantity of sheets having the same size, and a manual paper feed device 4 for manually supplying various types and various sizes of sheets.

An upper portion of the copying machine 1, there is provided with an image reading unit 5 for reading an original placed on this unit 5 and an original automatic feeding device (ADF) 6 for feeding the original to this image reading unit 5.

Further, a middle portion of the copying machine 1, there is provided with an image storing unit 7 for storing image data of the image read by the image reading unit 5 and a laser optical system 9 for fetching the image data stored therein and writing an image to be printed to an image forming unit 8.

Figure 2:
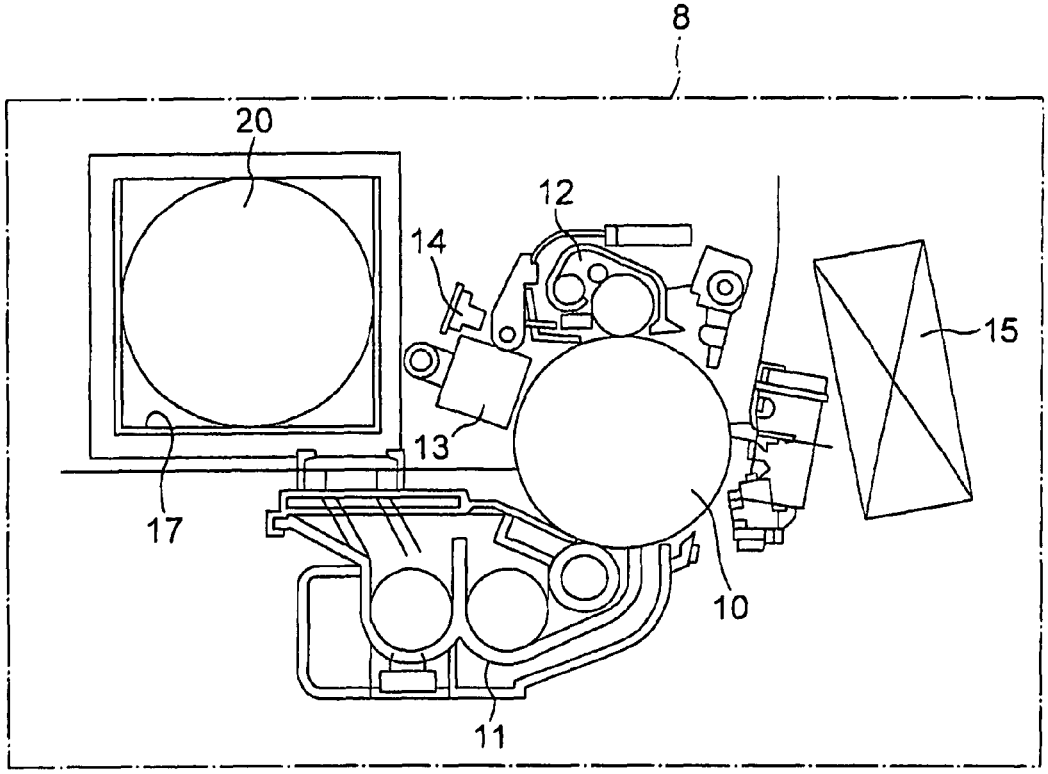
FIG. 2 is an explanatory view showing an outline of a configuration of an image processing unit for which the toner container of the present invention is used within the image forming apparatus shown in FIG. 1.

A construction of the image forming unit 8 will be explained with reference to FIG. 2 in addition to FIG. 1. The image forming unit 8 has a photosensitive drum 10 of which a surface is formed with an electrostatic latent image corresponding to the image data by the laser optical system, an electrification charger 13 for charging photosensitive drum 10, a developing unit 11 for developing the electrostatic latent image by supplying a toner, a transfer charger for transferring a developed image on a photosensitive drum 16, a de-energizing lamp 14 for de-energizing (removing the electric charge on) the surface of the photosensitive drum 10, and a leaner 12 for cleaning the surface of the photosensitive drum. The developing unit 11 is supplied with the toner from a toner supply container (toner cartridge) 20 supported by a toner container supporting unit 17. Note that toner container supporting unit 17 is provided with a drive unit for rotating the toner container 20 in a way that engages with this container 20.

Figure 3:
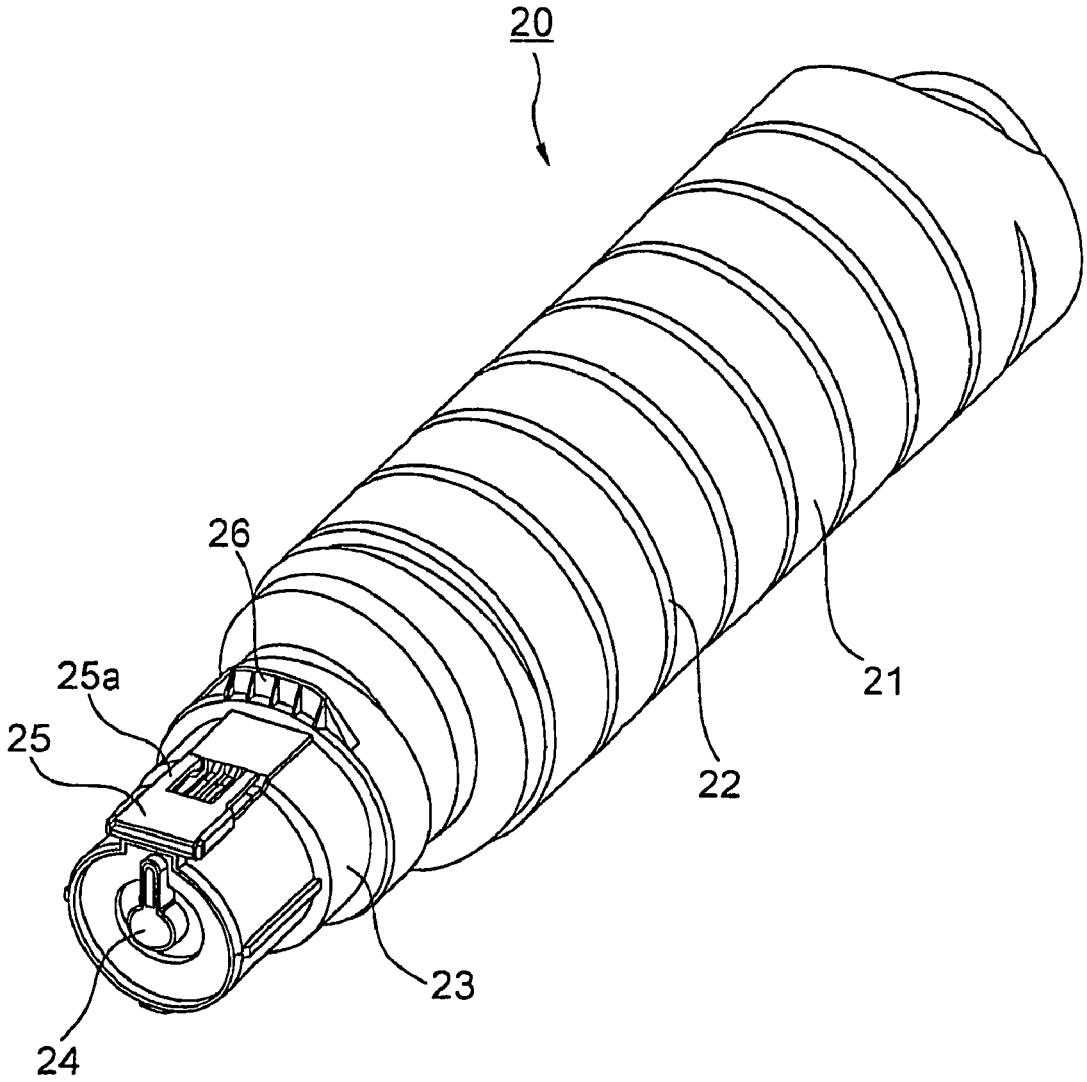
FIG. 3 is a perspective view illustrating an external appearance of the toner container in one embodiment of the present invention.
Figure 4:
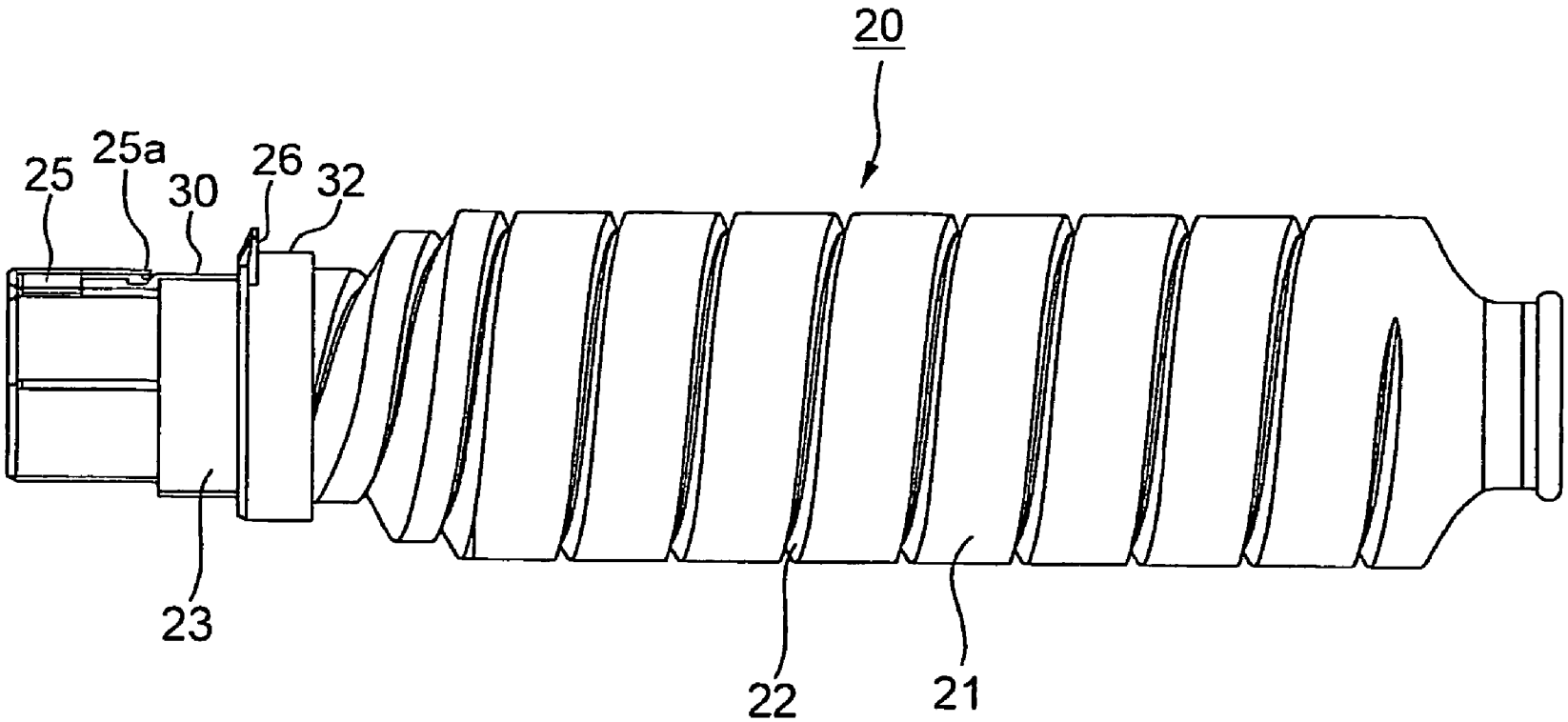
FIG. 4 is a front view illustrating the external appearance of the toner container according to one embodiment of the present invention.

FIG. 3 is a perspective view illustrating a overall appearance of the toner container 20 according to the present invention. FIG. 4 is a front view thereof. A cylindrical body 21 containing the toner is constructed of a plastic container taking a cylindrical shape, and, as will be explained later on, the toner container is rotated within the image forming apparatus, corresponding to a state of a toner consumption. A helical groove 22 is formed along the periphery of the toner container body 21. This groove 22 configures a protruded wall surface on the side of an internal surface of the container body 21, whereby the toner existing in a recessed portion between streaks of the protruded wall surface is moved towards a toner supply port as the toner container 20 rotates.

On a proximal side in FIG. 3, a bottle cap member 23 engaging with the toner supply device, for rotating the toner container 20 as a cylindrical end portion. This bottle cap member 23 is spirally coupled to the toner supply device in such a way that a thread formed on an external surface of a front end portion of the container body 21 meshes with a thread formed on an internal surface of the bottle cap member 23. Note that the bottle cap member 23 and the container body 21 may be formed into one united body.

Figure 5:
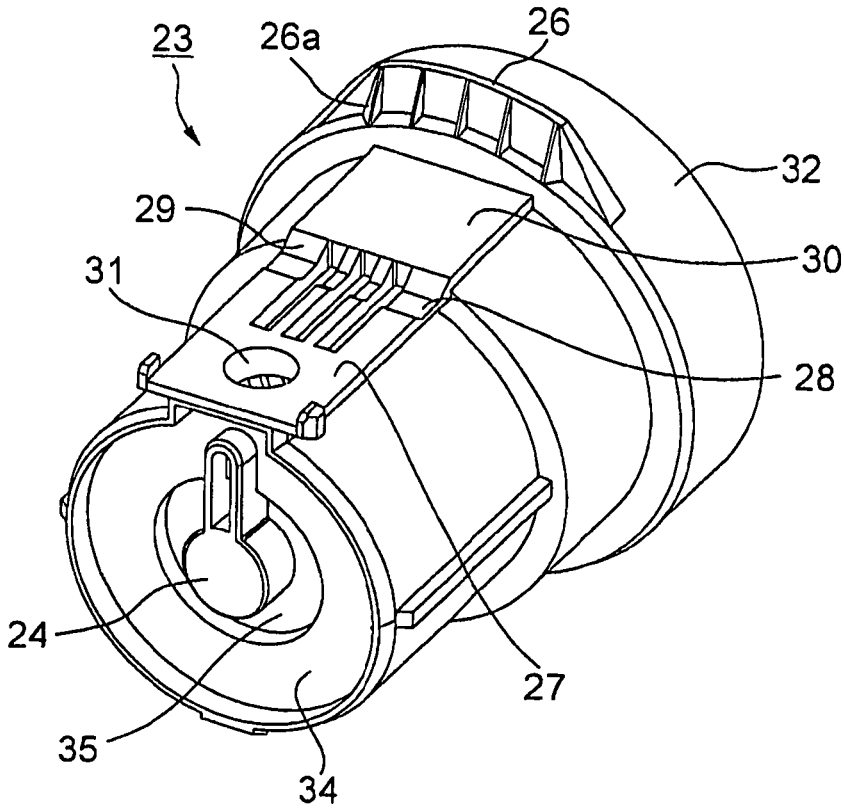
FIG. 5 is a perspective view illustrating a configuration of a bottle cap as a front portion of the toner container according to one embodiment of the present invention.
Figure 6:
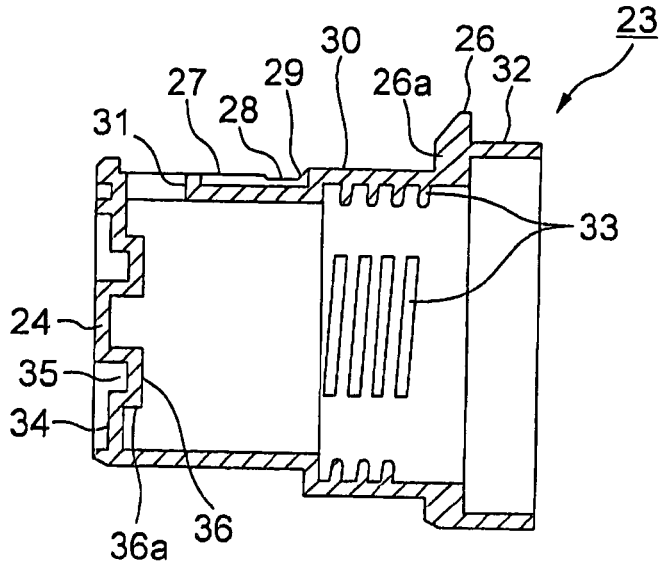
FIG. 6 is a sectional view showing an internal configuration of the bottle cap illustrated in FIG. 5.

FIG. 5 shows a detailed configuration of the bottle cap member 23. FIG. 6 shows a vertical sectional view thereof.

The front end portion of the bottle cap member 23 is formed with a protruded member 24. This protruded member 24 serves, as will be described later on, to surely firmly engage with a rotation driving mechanism of the toner supply device.

Referring again to FIGS. 3 and 4, a shutter 25 slidable in axial directions is provided on the surface of the front end portion of the bottle cap member 23.

FIGS. 5 and 6 show a state where the shutter itself is detached. A slide plate 27 on which the shutter 25 slides is configured to include an overhanging member provided on a cylindrical surface of the front end portion, and a pawl extending downwards of a side end portion of the shutter 25 engages with this overhanging member. A toner supply port (hole) 31 for supplying the toner is formed in a position, proximal to the front end portion of the bottle cap member, of the slide plate 27. A slight recess 28 is formed in such a direction as to get away from the front end portion of the slide plate 27. This recess 28 serves for stable positioning of a shutter front end portion 25*a* when the shutter 25 is in a fixed position to cover the toner supply port 31. Then, when the shutter 25 opens, the shutter front end portion 25*a* moves upwards along an inclined surface 29 and comes to arrive at on a stable surface 30 formed as a flat surface.

The engaging side of the bottle cap member 23 with the container body 21 has the largest diameter throughout within the bottle cap, and a protrusion 26 is formed in a part thereof. For this protrusion, detailed description will be made later. A length of this protrusion 26 extends over only a part of the circumference, and its height at the front end portion does not exceed a major diameter of the container body. The protrusion 26 has several reinforcing plates 26*a* against a force applied when a micro-switch, etc. engages therewith.

Next, a structure of the internal surface of the bottle cap 13 will be explained.

The internal surface closer to the front end side than the protrusion 26 is formed with a thread 33 engaging with a thread helically formed at the front end portion of the toner container. A discontinuous formation of this thread 33 serves to facilitate removing the toner at a connecting portion. Note that these threads are formed as reversing screws in order that the bottle cap will not come off due to the rotations.

An outward portion of the protruded portion 24 of the front end portion is provided with a recessed portion 35 sank well deeper than a reference end surface 34 of the bottle cap 23, and hence a substantial length of the protruded member 24 increases. By contrast, an internal surface of this recessed portion 35 is formed as an internal-surface-sided protruded portion 36 reversely protruding large. In this configuration, the toner conveyed along the helical wall surface gets on a peripheral surface 36*a* of the internal-surface-sided protruded portion 36 and, a distance from this position up to the toner supply port being short, stably conveyed from the toner supply port 31, thereby stabilizing the toner supply.

Note that it is recommended as for a size of the protruded member 24 that a total sectional areal size of the protruded member be equal to or larger than 30% and desirably equal to or larger than 50% in the case of assuming a circle having a radius of 1 cm.

Figure 7:
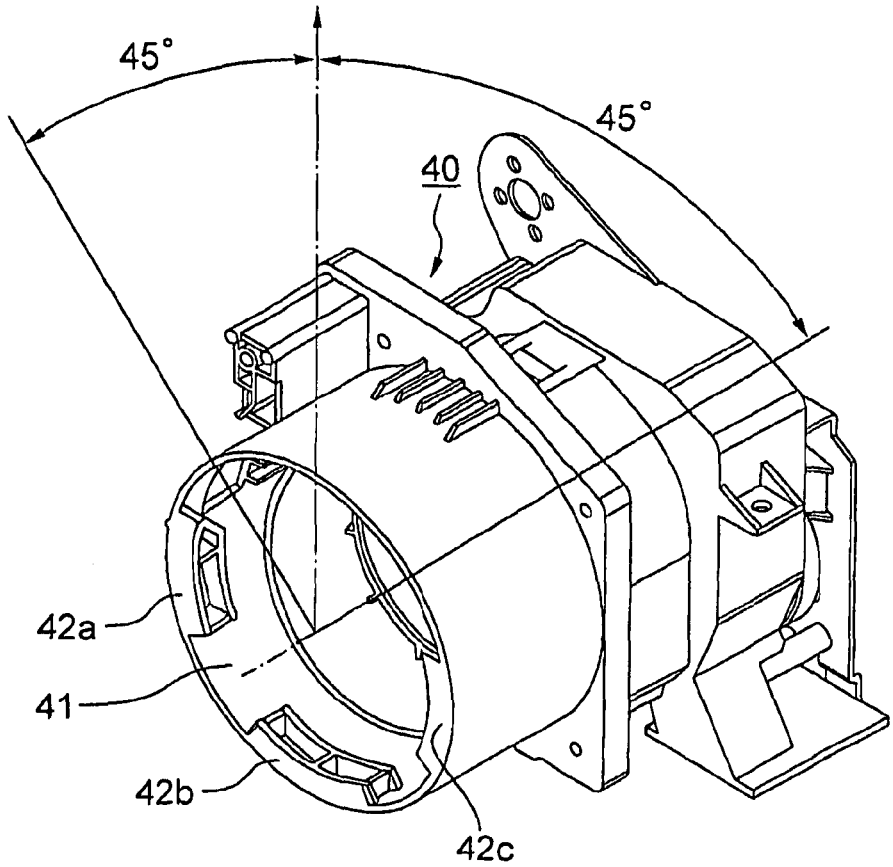
FIG. 7 is a perspective view showing an external appearance of a drive unit for rotationally driving the toner container by setting this container.
Figure 8:
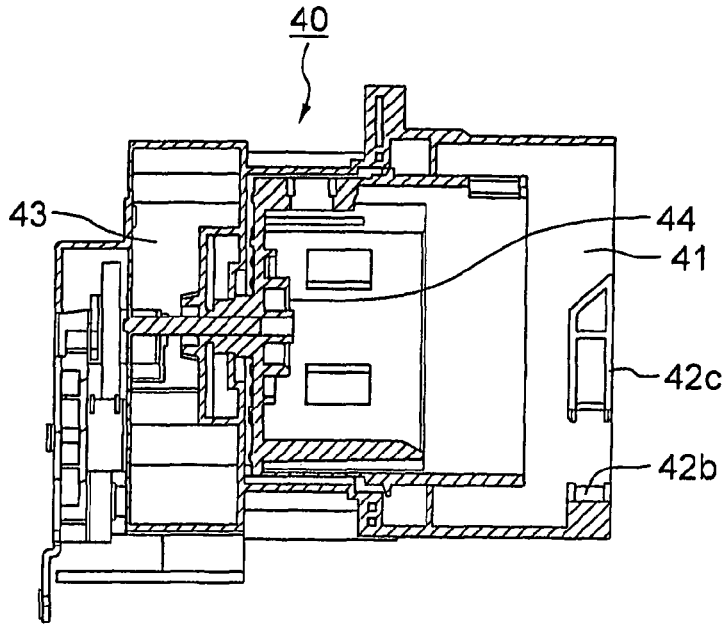
FIG. 8 is a sectional view showing an internal configuration of the drive unit shown in FIG. 7.

FIG. 7 is a perspective view of a drive unit 40 that engages with and thus rotating the bottle cap member described above. FIG. 8 is a sectional view of the drive unit 40. Provided on the left side in FIG. 8 is a gear box 43 having a plurality of gears rotationally driven by a motor (not illustrated).

The bottle cap 23 is inserted from an inlet area 41, however, because of restriction members 42*a*, 42*b*, 42*c* provided respectively at lower, left and right portions, in a case where the protrusion 26 faces in a fixed direction, i.e., if the center of the toner supply port 31 or of the protrusion 26 falls within a range of ±45° on the basis of the perpendicular direction with respect to a central axis of the toner container, the toner container can be attached and detached. These functions enable an effective prevention of a scatter of the toner from the toner supply port 31 when the toner container is attached and detached.

Further, the protruded member 24 described above is filled with a resinous material and therefore has advantages, wherein this member 24 exhibits a large strength on the occasion of engaging with a drive shaft, and an accident of being damaged due to the recessed structure adopted by the prior art, is hard to occur.

Thus, the protrusion 26 utilized for only detecting the genuine toner and the agitated state of the toner, is also used as a restriction guide for the positions of inserting and removing the container. Hence, a length requirement for the circumference of the protrusion 26 is that it be a length not interfering with the attaching/detaching restriction members 42*a* through 42*c* on the side of the drive unit when attached and detached in the normal positions.

Moreover, according to this embodiment, a rear side of the protrusion 26 has a cylindrical surface 32 that is large in width. This cylindrical surface is a cylindrical surface that is smaller in its major diameter than the cylindrical surface of the toner container body 21.

The reason why this configuration is adopted is that the surface positioned opposite to the toner replenishment port remains as the sufficiently wide cylindrical surface to form a clearance with respect to the guide width of the opposite member so that the protrusion 26 can perform the sure restriction by interfering with the attaching/detaching restriction members beyond the above range of the angle. The width of this cylindrical surface may be a size large enough not to hinder the interfering motion of the protrusion 26 with the attaching/detaching restriction members and, it is desirable, be normally equal to or greater than twice the width (in the axial directions) of the protrusion and preferably be equal to or greater than three times.

Further, the provision of this cylindrical surface makes it feasible to grasp the toner container by catching the lower part of the protrusion with a hand on the occasion of encasing the toner container 20 vertically into a package or taking it out of this package, thus improving a stability of handling with the toner container.

As discussed above, according to this embodiment, the protrusion used for only detecting the genuine toner and the toner rotating operation is made to function also as the restriction member for restricting in order to prevent the toner from scattering when attached and detached.

Furthermore, with a downsize of the image forming apparatus, some have such a contrivance that the protrusion detecting switch is provided on the side of the rotation driving device for the toner container existing inside the apparatus. For applying to these apparatuses, according to this embodiment, the protrusion 26 is provided closer to of the toner supply port than a half of the total length of the container.

On the other hand, the protruded member 24 for driving the bottle cap 23 needs engaging with a guide 44 of the drive shaft within the drive unit 40. According to this embodiment, however, the periphery of the protruded member 24 is formed with the recessed portion 35 sank deeper than the reference end surface, and hence the substantial height of the protruded member 24 increases, thereby making it possible to ensure the sufficient engagement with the drive shaft guide 44.

Moreover, a diameter of the front end portion of the protrusion 26 is set smaller than the major diameter of the container body 11, and therefore the maximum diameter is a diameter of the container body 11. This implies a reduction in capacity required for packing, transporting and stocking the toner container, and it follows that costs therefor decrease.

FIGS. 9 to 12 inclusive are perspective views showing modified examples in which the shape of the protruded member 24 illustrated in FIG. 5 is changed.

Figure 9:
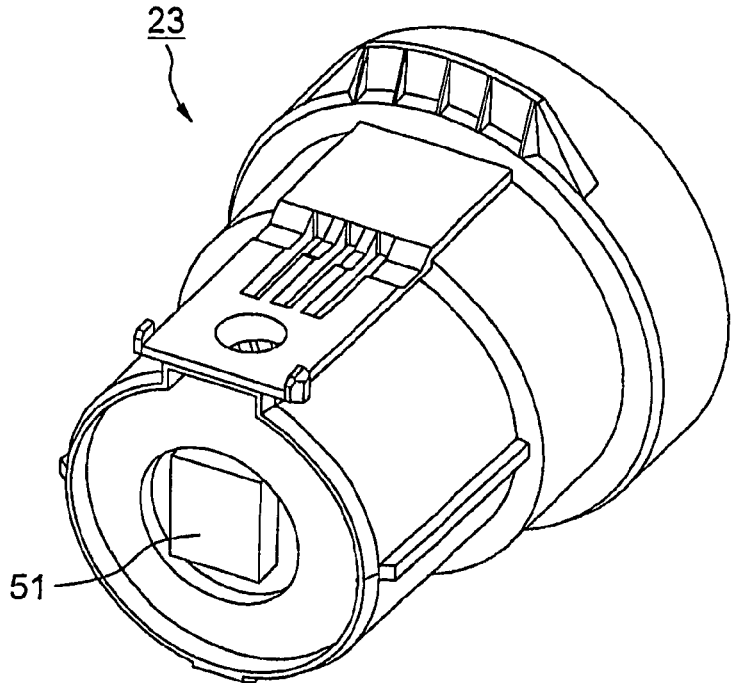
FIG. 9 is a perspective view showing a modified example of a protruded member at a front end portion of the bottle cap.

FIG. 9 shows that the flat surface of the protruded member is formed in a square shape. The configuration is not, however, limited to this and may involve using triangular or more polygonal shapes. The purpose is accomplished if capable of transmitting the rotational driving force in a way that engages with the drive shaft, and hence whatever polygonal shapes can be used without being limited to neat shapes such as a regular polygon.

Figure 10:
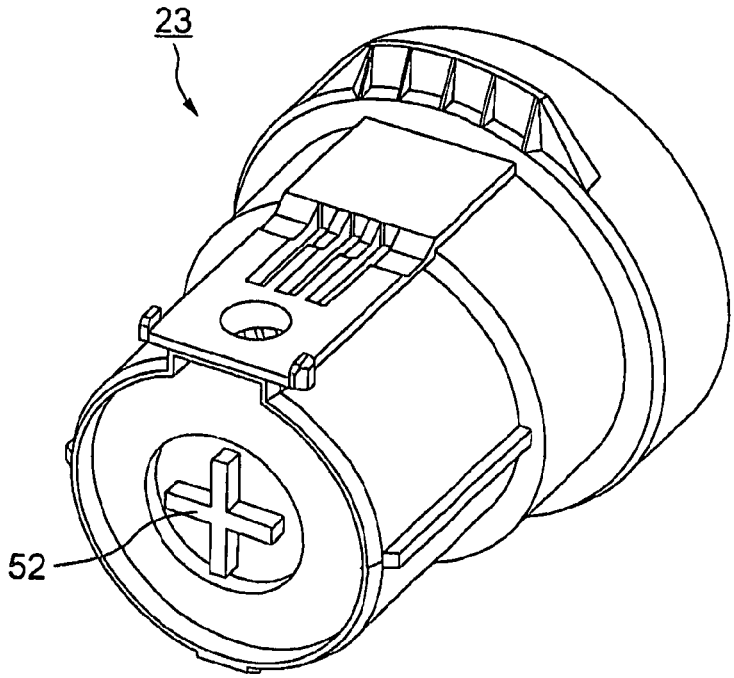
FIG. 10 is a perspective view showing a modified example of the protruded member at the front end portion of the bottle cap.
Figure 11:
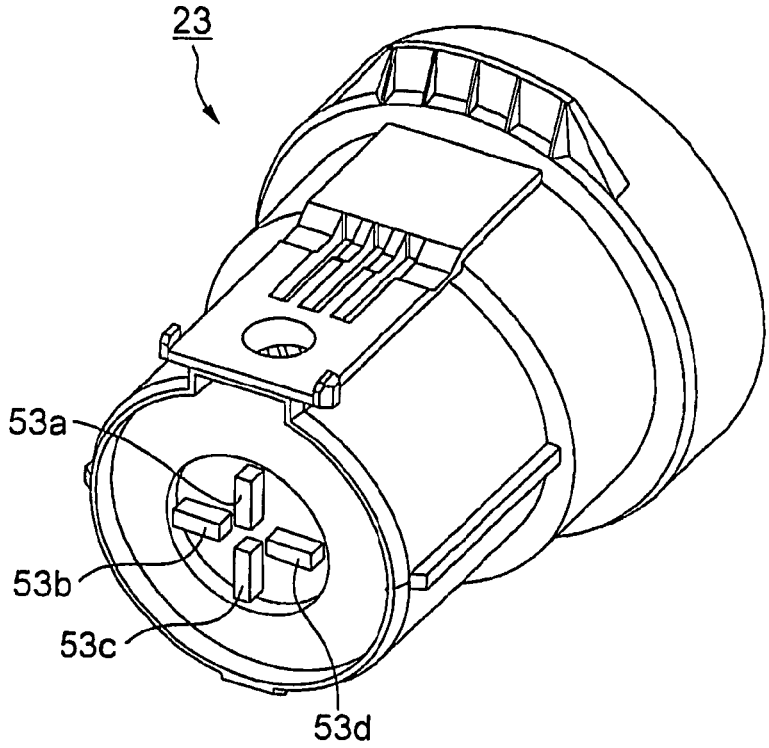
FIG. 11 is a perspective view showing a modified example of the protruded member at the front end portion of the bottle cap.

In FIGS. 10 and 11, a cross shape is adopted. As compared with the normal cross shape in FIG. 10, FIG. 11 illustrates a shape configured by removing the intersection from the cross shape. In these cases, lengths, etc. of the respective bar segments configuring the cross shape may arbitrarily be selected.

Figure 12:
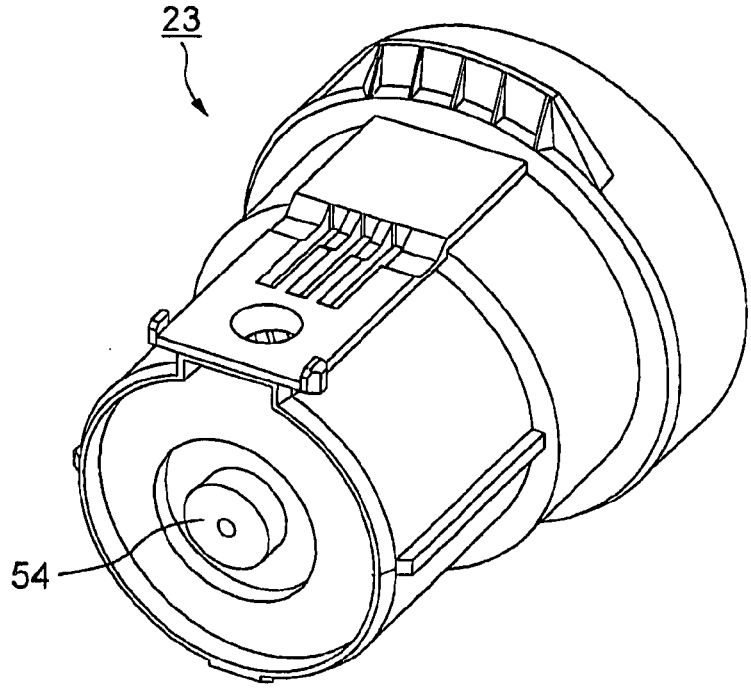
FIG. 12 is a perspective view showing a modified example of the protruded member at the front end portion of the bottle cap.

FIG. 12 shows a circular shape for the protruded member. In this case, however, the rotation can not be transferred, so that the toner container can be rotated by engaging with, for example, a protruded portion 55 formed rectilinearly in parallel with the axial directions on a side surface of the bottle cap.

The embodiment discussed above adopts the structure of enabling the container body and the bottle cap to be separated, however, the container body and the bottle cap may also be formed by integral molding.

In a toner contained according to an embodiment of the present invention, a periphery of a protruded member provided at a front portion is recessed, a height of this protruded member is substantially large, and therefore an engagement with a drive shaft is surely performed when the toner container is set in an image forming apparatus and then rotationally driven. Besides, this recessed portion has a cylindrical surface formed just under a toner supply port within the toner container, thereby stably supplying the toner.

Moreover, in the toner container according to the embodiment of the present invention, a protrusion for restricting attaching/detaching in a way that interferes with an attaching/detaching restriction member in a rotation mechanism at such a rotational angle that the toner might be scattered from the toner supply port when set in the image forming apparatus, is formed on a peripheral surface that is closer to rear end than a shutter mechanism provided on the front side of a cylindrical body unit, thereby enabling the attaching/detaching to be effectively restricted in order to prevent the toner from scattering.

Still further, a maximum height of the protrusion from the center of the cylinder is smaller than a major diameter of the cylindrical body unit, and there is provided a sufficiently-wide cylindrical surface on the rear side thereof. Hence, a handling characteristic is improved, and a size of the whole becomes compact, whereby costs for packing, transporting and stocking can be reduced.

What is claimed is:

1. A toner bottle rotatable along a direction of a rotation axis of the toner bottle, comprising:

a bottle body elongated along the rotation axis of the toner bottle which contains toner, the bottle body having a first portion and a second portion along the rotation axis, a diameter of the second portion being smaller than a diameter of the first portion;

a toner supply port provided at the second portion;

a helical groove formed on a periphery of the bottle body to move toner from an end portion of the toner bottle towards the toner supply port;

a shutter slidable along the rotation axis to open and close the toner supply port;

a protrusion formed on a circumferential surface of the second portion;

a cylindrical surface portion formed on a rear side of the protrusion and having a predetermined length along the rotational axis, wherein a diameter of the cylindrical surface portion is largest within the second portion along the rotation axis, wherein a height of the protrusion is smaller than the diameter of the first portion, a protruded member formed on an end face of the second portion for engaging with a driving device of an image forming apparatus; and a step portion provided between the protruded member and an outermost part of the second portion in diameter enveloping the protruded member, the step portion having a height that is higher than an end of the cylindrical surface and lower than the outermost part of the second portion.

2. The toner bottle according to claim 1, wherein a top of the protruded member is on an end face of the second portion.

3. The toner bottle according to claim 1, wherein a bottom part of the protruded member is on a recessed face from the step portion, the recessed face being located directly under the toner supply port in the second portion.

4. A toner bottle rotatable along a direction of a rotation axis of the toner bottle, comprising:

a bottle body elongated along the rotation axis of the toner bottle which contains toner;

a bottle body having a first portion and a second portion along the rotation axis, a diameter of the second portion being smaller than a diameter of the first portion;

a toner supply port provided at the second portion;

a helical groove formed on the periphery of the bottle body to move toner from an end portion of the toner bottle towards the toner supply port;

a shutter slidable along the rotation axis to open and close the toner supply port;

a protrusion formed on the circumferential surface of the second portion and having a predetermined length along the circumferential surface of the second portion;

a cylindrical surface portion formed between the protrusion and the first portion having predetermined length along the rotational axis;

a reinforcing member on a back of the protrusion to reinforce the protrusion;

a height of the protrusion being smaller than the diameter of the first portion, wherein the reinforcing member comprises a plurality of reinforcing plates.

5. A toner bottle rotatable along a direction of a rotation axis of the toner bottle, comprising:

a bottle body elongated along the rotation axis of the toner bottle which contains toner; the bottle body having a first portion and a second portion along the rotation axis, a diameter of the second portion being smaller than a diameter of the first portion;

a toner supply port provided at the second portion;

a helical groove formed on a periphery of the bottle body to move toner from an end portion of the toner bottle towards the toner supply port;

a shutter slidable along the rotation axis to open and close the toner supply port;

a protrusion formed on a circumferential surface of the second portion and having a predetermined length along the circumferential surface of the second portion;

a cylindrical surface portion formed on a rear side of the protrusion and having predetermined length along the rotational axis;

a reinforcing member at a front side of the protrusion and on a back of the protrusion to reinforce the protrusion;

wherein a diameter of the cylindrical surface portion is largest within the second portion along the rotation axis and a height of the protrusion is smaller than the diameter of the first portion, and wherein the reinforcing member comprises a plurality of reinforcing plates.

* * * * *